United States Patent [19]

Mitchell

[11] 4,380,139

[45] Apr. 19, 1983

[54] ANCHORING APPARATUS

[76] Inventor: Ronald Mitchell, 4600 W. Second St., Roswell, N. Mex. 88201

[21] Appl. No.: 187,433

[22] Filed: Sep. 15, 1980

[51] Int. Cl.[3] ..... E02D 5/74

[52] U.S. Cl. ..... 52/162

[58] Field of Search ..... 52/166, 162, 163, 164, 52/160

[56] References Cited

U.S. PATENT DOCUMENTS

| | | | |
|---|---|---|---|
| 772,515 | 10/1904 | Jackman | 52/162 |
| 876,127 | 1/1908 | Zimmerman | 52/162 |
| 1,123,368 | 1/1915 | Pieper | 52/160 |
| 1,726,526 | 8/1929 | Colvin | 52/160 |

FOREIGN PATENT DOCUMENTS

| | | | |
|---|---|---|---|
| 242834 | 11/1925 | United Kingdom | 52/160 |

*Primary Examiner*—Price C. Faw, Jr.
*Assistant Examiner*—Henry E. Raduazo
*Attorney, Agent, or Firm*—Gipple & Hale

[57] ABSTRACT

An anchoring apparatus for mobile homes comprising a pair of fluke members rotatably and slidably mounted on a pin. Each of the fluke members is constructed of a top plate and a pair of support arms secured to the top plate. Each support arm defines a slot into which the pin is positioned so that upon rotation of the fluke members the support arms of each fluke member abut against the top plate of the other fluke member to prevent further movement of the fluke members.

14 Claims, 8 Drawing Figures

ANCHORING APPARATUS

BACKGROUND OF THE INVENTION

The present invention generally relates to an anchor and more particularly to an anchor for securing a mobile home or the like to the ground.

Because of the mobile nature of our society and various economic conditions including increased building costs and lack of land space, modular housing, commonly called mobile homes, is being extensively used for dwelling purposes in all parts of the United States. Such mobile homes are usually initially mounted upon wheels and towed to the site of usage behind a towing vehicle. Once the mobile home is positioned in the area in which the owner desires to have the house located, the mobile home is mounted on blocks or jacks and the wheels are usually removed.

While the weight of the mobile home is sufficient to permit it to remain stationary in its parking place when blocks are placed around the wheels or when the mobile home is mounted on blocks and the wheels are removed, the mobile home is not actually secured to the ground. This resting of the mobile home does not produce support or stability sufficient to adequately insure against shifting of the mobile home due to normal vibrations or wind forces. The mobile home is also subject to being damaged or destroyed by high winds because it is not anchored or secured to the ground and is subject to a considerable rocking and moving about during wind conditions making the living conditions somewhat unconfortable.

Anchors for mobile homes therefore can provide restriction on unwanted movement which would otherwise alarm occupants and damage utility connections. The statutes of many states require anchoring of mobile homes.

Since mobile homes vary in length and width it is not economically feasible to have a fixed securing means for each side of the trailer. The present invention satisfactorily solves this problem by providing an anchoring device that is readily usable with mobile homes of any length or width.

Furthermore, the anchoring device of the present invention is particularly adapted for use where a concrete apron is not utilized, as the device can be used in the earth. If desired, however, the anchor can be connected into the earth.

The present invention, in addition to overcoming the above-mentioned problems, is simple and inexpensive to construct and install and is strong, durable and efficient in use.

Anchoring devices are well known which have the purpose of preventing a mobile home from being adversely affected by winds ranging from slight to hurricane force. One group of anchoring devices may be generally classified as tie down anchors and are representatively illustrated by U.S. Pat. Nos. 3,744,192; 3,691,703; and 3,054,151. These tie down anchors generally comprise a metal rod device which is secured in cement with a strap or other suitable holding means being secured to the rod and placed around the body of the mobile home to hold it in place.

Additional anchoring devices are used which are attached to the undercarriage of the mobile home. Such devices are disclosed by U.S. Pat. Nos. 3,726,054; 3,724,151; and 3,403,487. These devices also have members which are embedded in concrete with the tops of the anchors being secured to suitable linkage means which is attached to the undercarriage of the mobile home.

Other United States Patents have also disclosed various types of land anchor apparatus utilizing a post or stem which is driven into the ground and which has a plurality of flukes rotatably mounted thereto as that when the stem is lifted back out of the ground, the post is firmly attached into the ground. Such devices are shown by U.S. Pat. Nos. 772,515; 891,171; 1,982,963; 1,008,323, 750,151; 219,703 and 152,091. Other earth anchoring apparatus have been used as those shown in U.S. Pat. Nos. 3,270,704 and 720,225 in which the flukes are slidably mounted within the stem so that the flukes in combination with the stem form the anchoring device.

Other mooring apparatus include the toggle bolt type anchoring devices which open to grip the underside of a surface. For devices of this type, see U.S. Pat. Nos. 2,605,668; 2,061,634; 1,228,512; 2,132,284; 3,170,361; and 3,332,118, as well as United Kingdom Patent No. 325,775 and German Pat. No. 49,720.

SUMMARY OF THE INVENTION

The present invention provides a simple, compact and inexpensive way of protecting and stabilizing parked trailers comprising an anchor apparatus adapted to be secured into the ground. The anchor apparatus is comprised of two fluke members, each of which is adapted to rotate about a pin means and to abut against each other so that rotation about the pivot pin means is prevented when each member has rotated a predetermined amount causing the fluke members to bite into the earth and secure the apparatus in a set position.

BRIEF DESCRIPTION OF THE DRAWINGS

The features and advantages of the present invention will be apparent from the following description, taken in conjunction with the accompanying drawings, in which.

DETAILED DESCRIPTION OF THE DRAWINGS

Figure 1:
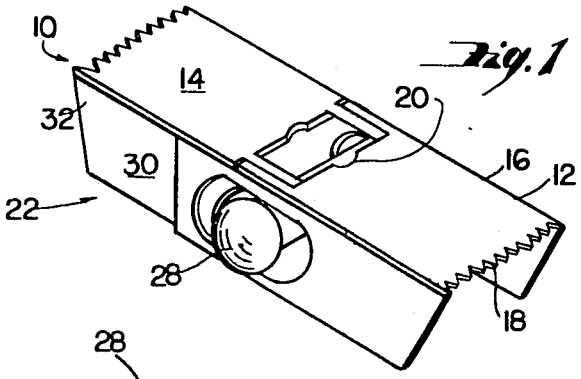
FIG. 1 is a perspective view of the anchor apparatus.
Figure 2:
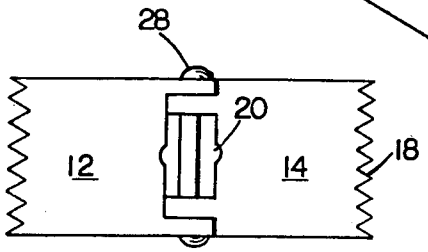
FIG. 2 is a plan view of the apparatus shown in FIG. 1.
Figure 3:
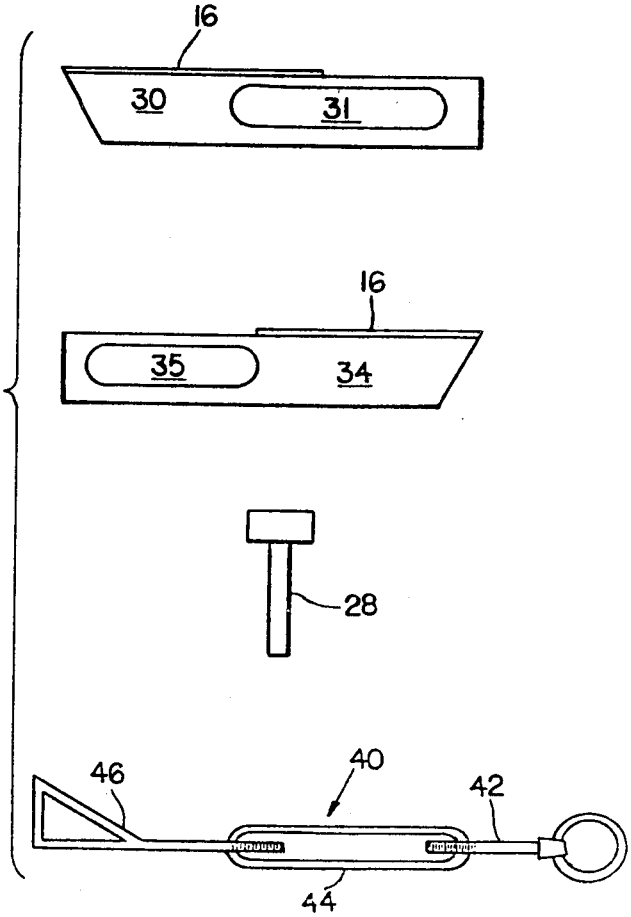
FIG. 3 is an exploded side view of the parts of the apparatus as shown in FIG. 1 including a tenacious means.

The present invention can be used with a tie down anchor or attached to the undercarriage of the mobile home.

In FIGS. 1 through 6, an anchor apparatus 10 is disclosed comprising a pair of fluke members 12 and 14. Each fluke member basically comprises a planar top plate 16 defining a toothed end 18 and a notched end 20.

A plurality of support arms 22 are secured to the top plate and extend perpendicularly away from the top plate and past the notched end of the top plate a distance not greater than the length of the top plate. Each of the support arms 22 defines a longitudinal slot 26 which is adapted to receive a pin 28.

The support arms of each fluke member are so constructed that they abut the bottom of the top plate of the other fluke member to lock each fluke member in a fixed position after each fluke member has been rotated to a predetermined position on pin 28. Fluke member 14 is referred to as the inner fluke member since its support arms 30 are recessed from the edge of the top plate 16 in their secured position to form a seat 32. The slot 31 in each of the support arms 30 of the inner member are longer than the slot 35 of the opposing outer support arms 34. In the other fluke member 12 or outer fluke member the support arms 34 are secured to the top plate preferably flush to the edge of the top plate so that they can rest on seat 32 formed by the recessed support arms 30 and top plate 16 of the inner fluke member 14.

In the invention, an adjustable tensioning apparatus 40 is mounted to the anchor apparatus by placing the pin 28 through an eye formed in the tensioning apparatus 40. The pin 28 is placed through the eye of the anchor attaching member 42 which has been inserted through the notched ends 20 of the two fluke plates. The tensioning apparatus is used to adjustably connect the anchor to the mobile home or linkage connected to the mobile home. The tensioning member 40 basically comprises an anchor attaching member 42 in the form of an eye bolt, a turnbuckle 44 and a mobile home tie member 46. The tie member 46 preferably is triangularly shaped on one end although it may take the form of a hook shaped bolt. The anchor support member 42 has a tubular body, one end of which is threaded as is one end of the tie member with the threaded ends of both members fitting in the turnbuckle 44, so that the turnbuckle can be used to adjustably loosen or tighten the anchor with either the mobile home or a cable, rope or other linkage secured to the mobile home.

In operation, the anchor fluke members are rotated on the pivot pin 28 so that they form an angular configuration allowing them to be placed within a post hole or other suitable hole which is dug in the ground. The two flukes are slidably and rotatably mounted on the pin with each of the flukes having a slot cut into its body which allows it to slide over the pivot pin. Each fluke has one end forming a toothed edge which cuts into the ground with the other end being adapted to be locked into position against the other fluke member when the fluke members are brought into horizontal or 180° position by either the previously described tensioning member, a cable, rope or any other suitable tensioning member, which is secured or connected to the mobile home. The extending arm or support of each fluke member forms a lock arm which is constructed to abut and lock against the top plate of the other respective fluke. The adjustable tensioning means 40 is mounted on the pivot pin 28 as previously indicated so that the trailer connections are tightened by grasping the turnbuckle and rotating the same in a tightening direction by hand pressure or other suitable means. The tightening is continued until the desired amount of tensioning force is developed.

Figures 4, 5:
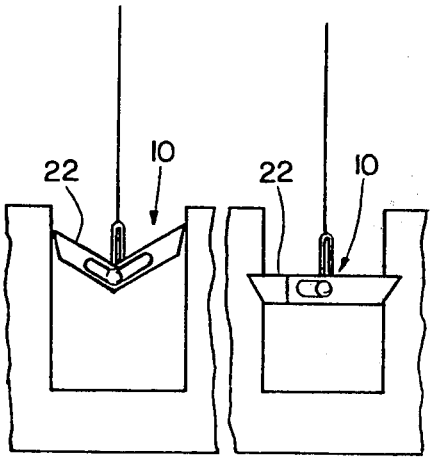
FIG. 4 is a front view of the anchor apparatus being placed in an earthen hole.
FIG. 5 is a front view of the anchor apparatus in an anchoring position within the earthen hole.
Figure 6:
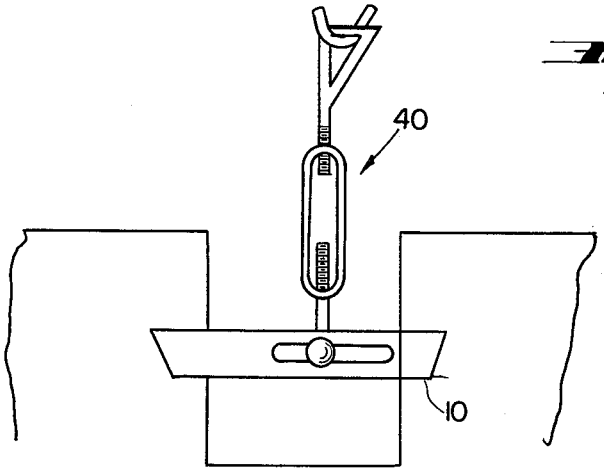
FIG. 6 is a front view of the apparatus of FIG. 5 used in an alternate anchoring position in conjunction with a turnbuckle.

When the extending arm of each fluke member achieves the horizontal lock position, the pivot pin 28 ordinarily rests in the ends of slots 31 and 35 closest to the middle of the flukes 30 and 34, respectively, as is illustrated in FIG. 5. However, when the diameter of the ground hole is less than the length of a fluke, the end of each extending arm will abut the side of the hole before the pivot pin 28 reaches the ends of slots 31, as shown in FIG. 6. Thus the flukes are forced to penetrate the ground because collapse into one another is no longer possible.

Figure 7:
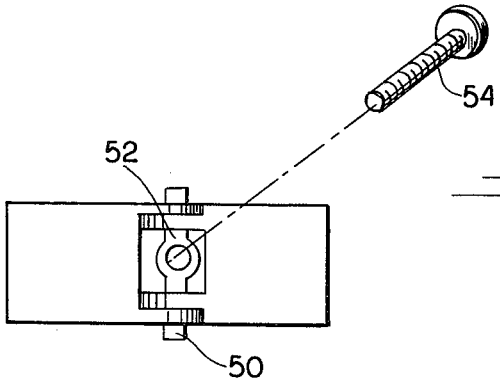
FIG. 7 is a partially exploded view of another embodiment of the invention.
Figure 8:
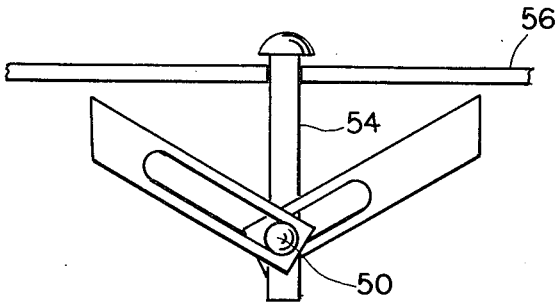
FIG. 8 is a side elevational view of the embodiment of FIG. 7 with a bolt inserted in the pivot pin.

In another embodiment as shown in FIGS. 7 and 8 the pin 50 has a hole 52 drilled through it which is preferably threaded to allow a threaded bolt 54 to be secured into the pivot pin 50. If desired, the threaded bolt can have torque receiving means formed on one end.

In the embodiment shown in FIGS. 7 and 8, the pin can have an enlarged flat area 51 as is shown to receive the threaded screw or bolt 54 forming an anchor type bolt. When the bolt 54 is tightened, the fluke members are brought to relationship with each other as previously discussed, providing an anchor for fastening an object on the wall 56 or other area.

While the preferred embodiment of the invention has been disclosed, it is understood that the invention is not limited to such an embodiment since it may be otherwise embodied in the scope of the appended claims.

What is claimed is:

1. An anchoring apparatus comprising a pair of fluke members, each fluke member comprising a planar top plate and at least two support arms secured in a substantially perpendicular orientation to said top plate and extending longitudinally away from said top plate with their top sides being substantially parallel to said planar top, each said support arm defining a slot, pin means positioned in each said support arm slot, each said support arm being adapted to slide and rotate on said pin means so that the portion of the support arm extending away from the top plate abuts against the bottom of the top plate of the other fluke member, said pin means defining an eyelet with a threaded bore therethrough and tension means threadedly engaging said threaded eyelet adapted to keep said fluke member locked into abutting position.

2. An anchoring apparatus as claimed in claim 1 wherein one end of each said top plate is toothed and the other end defines a notch.

3. A mobile home anchoring device comprising support means, a pair of flukes members rotatably and slidably mounted on said support means, each said fluke member comprising a planar top plate and a plurality of parallel support arms secured to said top plate, each said support arm extending longitudinally past the edge of said top plate with the support arm edge adjacent said top plate and extending longitudinally therefrom being parallel to said top plate and adapted to abut against the bottom of the top plate of the other fluke member to prevent movement of the fluke members, each of said arms defining a slot adapted to receive said support means and adjustable tensioning means mounted to said support means.

4. An anchoring apparatus as claimed in claim 3 wherein said adjustable tensioning means comprises a first member mounted to said support means, a turnbuckle threaded on said first member and a second member threaded on said turnbuckle.

5. An anchoring apparatus as claimed in claim 3 wherein said adjustable tensioning means is a rope.

6. An anchoring apparatus as claimed in claim 3 wherein said adjustable tensioning means is a cable.

7. An anchoring apparatus as claimed in claim 3 wherein said adjustable tensioning means is a chain.

8. An anchoring apparatus for anchoring mobile homes comprising a pair of fluke members, each said fluke member comprising a top plate, a plurality of substantially parallel support arms secured to said top plate in substantially perpendicular orientation and extending past one end of said top plate, each of said support arms defining a slot, pin means inserted through said arm slots of both fluke members allowing said fluke members to be slidably and rotatably moved thereon, one of said fluke member support arms being positioned inward from said top plate outer edge a greater distance than the support arms of the other fluke member, so that upon rotation of the fluke members the support arms of each fluke member abut against the top plate of the other fluke member to prevent further movement of the fluke members.

9. An anchoring apparatus as claimed in claim 8 wherein said top plate defines a toothed edge at one end and a notched edge at the other end and includes adjustable tensioning means mounted to said pin means.

10. An anchoring apparatus as claimed in claim 8 wherein the slots defined by the arms of one fluke member have a greater length than the slots of the other fluke member.

11. An anchoring apparatus as claimed in claim 8 wherein said support arms extend beyond the said top plate edge a distance which does not exceed the length of said top plate.

12. An anchoring apparatus as claimed in claim 1 wherein the support arms of each fluke member abut against the bottom of the top plate of the other fluke member.

13. An anchoring apparatus as claimed in claim 1 including tension means connecting said pin means and said mobile home.

14. An anchoring apparatus comprising a pin means, said pin means having a threaded bore therethrough, two fluke members slidably and rotatably mounted on said pin means, each said fluke member comprising a top plate, a plurality of support arms extending from said top plate and extending beyond said top plate edge, each of said support arms defining a slot therein having a width of sufficient dimension to accommodate said pin means and adjusting means adjustably secured to said pin means, said adjusting means comprising a threaded second pin means threadedly engaging said fluke member bore.

* * * * *